United States Patent [19]

Reist

[11] Patent Number: 4,582,272

[45] Date of Patent: Apr. 15, 1986

[54] APPARATUS FOR THE INTERMEDIATE STORAGE OF PRINTED PRODUCTS

[75] Inventor: Walter Reist, Hinwil, Switzerland

[73] Assignee: Ferag AG, Hinwil, Switzerland

[21] Appl. No.: 612,447

[22] Filed: May 21, 1984

[30] Foreign Application Priority Data

May 31, 1983 [CH] Switzerland ..... 2974/83

[51] Int. Cl.[4] ..... B65B 63/04; B65H 29/04; B65H 29/66

[52] U.S. Cl. ..... 242/59; 53/118

[58] Field of Search ..... 242/59, 55, 67.3 R; 53/118, 119, 430; 198/347, 423, 479; 270/52, 52.5, 54, 56; 271/149, 151, 202, 216, 303

[56] References Cited

U.S. PATENT DOCUMENTS

| | | | |
|---|---|---|---|
| 3,189,292 | 6/1965 | Torres | 242/56.4 X |
| 4,007,824 | 2/1977 | Reist | 198/423 X |
| 4,438,618 | 3/1984 | Honegger | 242/59 X |

FOREIGN PATENT DOCUMENTS

| | | | |
|---|---|---|---|
| 0054735 | 6/1982 | European Pat. Off. | 53/118 |
| 2092557 | 8/1982 | United Kingdom | 242/59 |
| 2119769 | 11/1983 | United Kingdom | 271/151 |

*Primary Examiner*—John M. Jillions
*Attorney, Agent, or Firm*—Werner W. Kleeman

[57] ABSTRACT

A transport apparatus is arranged downstream of a delivery belt of a rotary printing press. Controlled clamps of the transport apparatus individually entrain the printed products. Three conveyor devices are arranged in sequence in the transport path of the clamps, each of which leads to a driven winding mandrel or arbor. The clamps are opened by suitable control means such that printed products are deposited on each conveyor device in imbricated product formation such that they overlap at their edge regions. The printed products are then wound up to a compact coil or product package on the winding mandrel or arbor in such imbricated product formation.

4 Claims, 3 Drawing Figures

Fig. 3
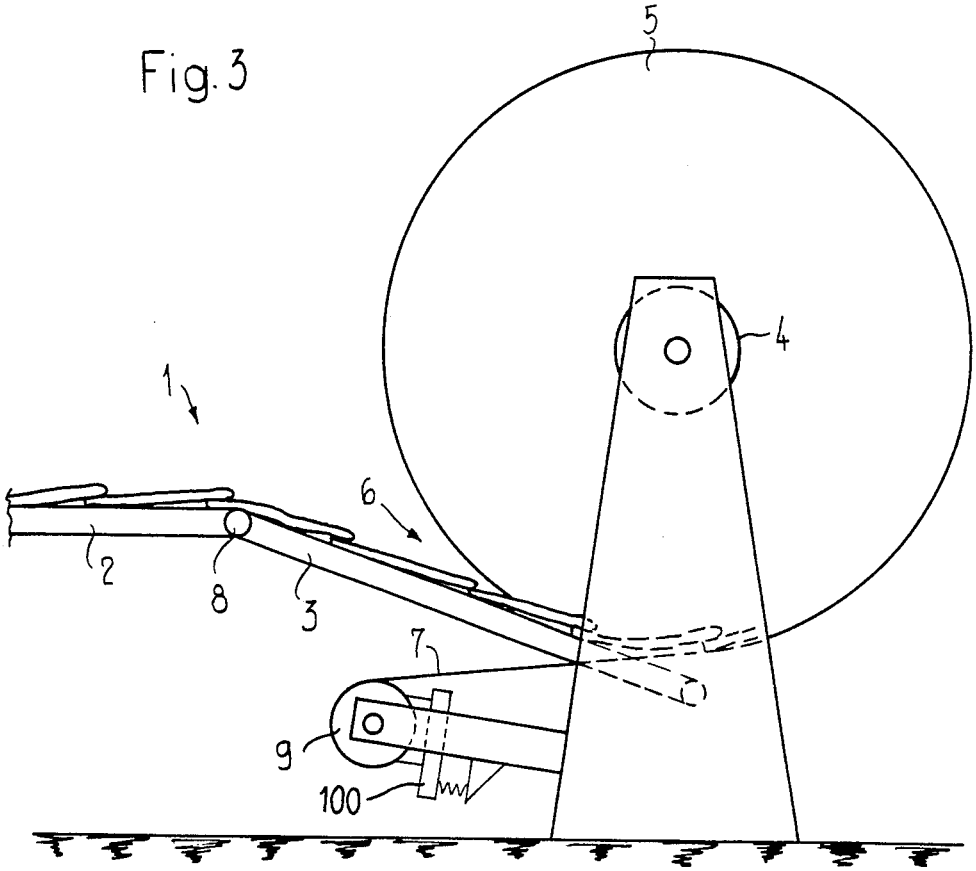
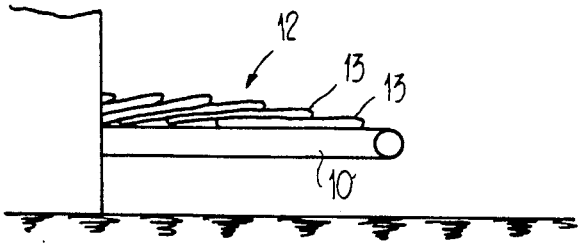
Fig. 1

APPARATUS FOR THE INTERMEDIATE STORAGE OF PRINTED PRODUCTS

BACKGROUND OF THE INVENTION

The present invention broadly relates to transport and storage apparatuses for printed products or the like and, more specifically, pertains to a new and improved construction of an apparatus for the intermediate storage of printed products.

Generally speaking, the apparatus of the present invention is intended for the intermediate storage of printed products, such as newspapers, magazines, periodicals and the like in imbricated product formation and comprises a winding mandrel or arbor for winding up the imbricated product formation and arranged to be rotatable and to be driveable at least during such winding up operation. A conveyor device conveys the imbricated product formation to the winding mandrel or arbor. A winding band or strap is capable of being connected to the winding mandrel or arbor. A tensioning device places the winding strap under a prescribable tension. The winding strap is wound between coil layers of the imbricated product formation during such winding up thereof. The conveyor device supplies a stream of the imbricated product formation conjointly with the winding strap in "underfeed" to the winding mandrel. The imbricated product formation arrives at the winding mandrel with leading edges of the printed products in contact with the winding mandrel or the last wound coil thereof, as the case may be.

In an apparatus known from the German Patent No. 2,207,556, granted June 12, 1975 folded printed sheets arriving in imbricated product formation are conducted between two guide bands or straps unwound from rolls and the stream or flow of sheets enclosed between this guide strap pair is conducted in overfeed to a winding mandrel preferably provided with side flanges or cheek plates and upon which the ends of the guide bands or straps are fastened, so that during the spiral coiling or winding-up operation, disturbances of the winding-up process at high machine speeds can be eliminated by the constant presence of two-sided containment of the sheets between the strap pair.

Although high operating speeds can be achieved with this known apparatus, the compactness prerequisite for a high storage capacity cannot be achieved since the compressible folded printed sheets within the coil or product package, both individually and as part of the imbricated product formation, can be only slightly compacted due to the direction of coiling resulting from winding up in overfeed. The result is a relatively loose coil wound product or product package having a storage capacity which leaves a great deal to be desired with respect to a given diameter of coil. Furthermore, narrow limits are placed upon the coil or package diameter.

These disadvantages do not arise in the apparatus known from the German Patent Publication No. 3,123,888 corresponding to the U.S. Pat. No. 4,438,618 granted Mar. 27, 1984. Since each inner coil layer or winding within the coil or product package formed by "underfeed" delivery of the imbricated product formation and supported on the winding strap or band—also referred to as a separation layer—can turn with respect to its surrounding or next adjacent outer or outer coil layer or winding without any mutual blocking in the direction of winding, it is possible, by prescribing the winding strap tension, to tighten or wind up the winding strap and with it the imbricated product formation supported between the individual coil layers of the winding strap in the manner of a watch spring. This results in a thoroughly compact coil or product package in which the firmly compacted and therefore radially rigidly compressed coil layers or windings of the printed products, such as the newspapers, magazines, periodicals or the like are in intimate contact.

The tension forces which must be exerted on the winding strap during this clock-spring-like winding-up or tightening are unexpectedly low. One of the determining factors is that the "underfeed" delivery of the imbricated product formation leads to a desired compression and compaction thereof. As a result of the continuous increase of the winding radius, the winding speed of the winding strap upon the coil or product package, and therefore the delivery speed or linear infeed velocity of the imbricated product formation, is greater than the peripheral or circumferential speed of the outer coil layer of the product package at that point at which the product spines of the currently arriving newspapers or magazines come into contact with the outer coil layer. As a consequence, the product spine is instantaneously retarded, braked or decelerated and conveyed further at the lower peripheral or circumferential speed corresponding to the momentary winding radius. The deceleration of the product spine, in turn, leads to a deceleration of the entire product copy or product. In the meantime, the subsequent product copy or product is being conveyed without hindrance and is displaced over the rear side of the precursive product copy or product until its product spine contacts the wound coil or package and is gripped in the clamping gap between the latter and the precursive product copy or product and is conveyed further at the lower peripheral or circumferential speed of the wound product coil. These actions are repeated from product copy to product copy, so that the imbricated product formation, as it is fed into the wound package coil by the tensioned "underfeed" winding strap, is compressed and correspondingly compacted. This fulfills the prerequisite for a firm wound package or coil. Since the compressibility of the imbricated product formation is increased by the compaction, so that the weight of the printed products, such as the newspapers or magazines carried by the loops or coils of the winding strap is transmitted to the printed products lying above the winding mandrel axis and at that location induce a compression, so that the thickness of the upper part of the wound package or coil is reduced and the thickness, respectively the radius, of the lower coil portion of the wound package is increased since the compression in the upper region enables a deflection or sagging of the loops or individual coils and a loosening of the coil layer of the wound package. When winding up, this leads to the excessively long next-outer coil layers rolling or sliding upon their respectively adjacent inner coil layers, similar to the rolling of an internally toothed planetary gear ring on a rotating pinion gear. During this rolling action, the winding mandrel or arbor (winding drum) can advance due to the presence of a free-wheeling action and, in a secondary winding up process, gradually tightens the loose coil layers of the wound package upon the compacting core of the product coil or package simultaneously with the winding up of the imbricated product formation from the exterior. Naturally, the weight of the printed products which leads to the compression of the currently uppermost coil layers increases, which is also advantageous for the compacting secondary winding-up operation. This entire procedure is made possible by the free-wheeling action leading to the re-coiling of the inner coils or coil layers of the product package upon the winding mandrel or upon one another during the formation of the product coil or package by the "underfeed" delivery of the imbricated product formation stream by means of a winding strap connected to the driven winding mandrel or arbor, i.e. simultaneously with the formation of the coil layers on the periphery of the wound product coil or package.

SUMMARY OF THE INVENTION

Therefore, with the foregoing in mind, it is a primary object of the present invention to provide a new and improved construction of an apparatus for the intermediate storage of printed products which does not have associated with it the aforementioned drawbacks and shortcomings of prior art constructions.

Another and more specific object of the present invention aims at providing a new and improved construction of an apparatus for the intermediate storage of printed products of the previously mentioned type employing the principle of spiral or clock-spring wind-up to increase the effectiveness of the secondary winding process and to thereby further compact the wound product coil or package, and, optionally, to simultaneously increase the coil or package diameter.

Yet another significant object of the present invention aims at providing a new and improved construction of an apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the apparatus of the present invention is manifested by the features that a product delivery or depositing apparatus is arranged upstream of the conveyor device for forming from the printed products an imbricated product formation overlapping at their edge regions, that is, a product depositing apparatus for forming from the printed products an imbricated product formation with the products overlapping at their edge regions is arranged upstream of or precedes the conveyor device delivering the imbricated product formation to the winding mandrel or arbor or the wound product package, as the case may be.

By limiting the overlapping to the edge region of the adjacent printed products, the compressibility of the imbricated product formation is naturally reduced. The fact that a damming-up or braking of the imbricated product formation also occurs in this case has no effect upon the reduced compressibility, since with such a broadly separated or fanned out imbricated product formation the difference between its speed and the momentary peripheral or circumferential speed of the outer coil layer is relatively small and the overlap still remains limited to the edge region. Even though this diminishes an essential prerequisite for attaining the spiral or clock-spring wind-up action, the desired result is nevertheless unexpectedly achieved since a given number of printed products produces a longer imbricated product formation and a correspondingly greater number of secondary winding processes can take place.

The limitation of the overlapping of the printed products to the edge or marginal regions, i.e. to a fraction or minor portion of the length of the products between their leading and trailing edges, furthermore means that the middle or central region of the printed products is exposed on both sides, so that the products can bear with their central regions upon the next inner coil layer and can support the next outer coil layer with their other sides. This broad or large area support naturally appreciably contributes to the stability of the wound product coil or package, so that it is possible to store the coil without complicated apparatus, e.g. it can simply be deposited in vertical position or it can be laid upon its side.

In a preferred embodiment of the invention for the intermediate storage of printed products arriving in imbricated product formation on a delivery belt, according to the invention two or more conveyor devices leading to a respective winding mandrel or arbor are arranged in the motion or travel path of the clamps or grippers of a transport device equipped with the product delivery or depositing apparatus arranged subsequent to the delivery belt, the controllable clamps or grippers of which are intended for individually gripping the products. Control means are arranged in the region of the conveyor device to release predetermined clamps or grippers, so that the printed products deposited upon the individual conveyor devices in imbricated product formation overlap in their edge regions. The entire production, e.g. of a rotary printing press, can thereby be processed to an extraordinarily compact and stable coil or product package at reduced winding speed.

The multiplication of the secondary winding process makes it possible to also obtain the aforementioned advantages in connection with printed products that are thin or not very compressible due to their structure, e.g. rotogravure products, wherein the intimate mutual contact of the coil layers and the broad or large area retention or engagement of the printed products by their respectively adjacent layer contribute to the result.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIG. 1 schematically shows a delivery belt for an imbricated product formation as it typically arrives from a rotary printing press or the like;

FIG. 3 is a schematic side view of an individual winding station.

DETAILED DESCRIPTION OF THE PREFERRED EMBODIMENTS

Figure 2:
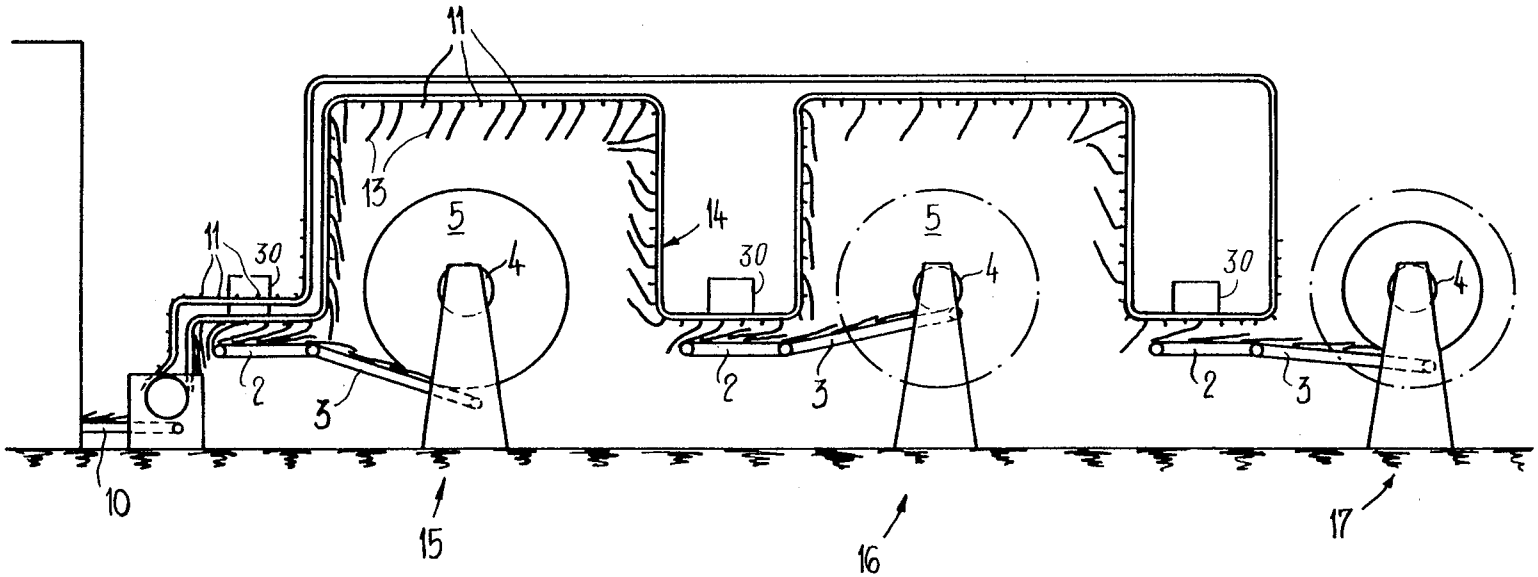
FIG. 2 schematically shows an arrangement having a transport apparatus arranged subsequent to the delivery belt.

Describing now the drawings, it is to be understood that to simplify the showing of the drawings only enough of the structure of the apparatus for the intermediate storage of printed products has been illustrated therein as is needed to enable one skilled in the art to readily understand the underlying principles and concepts of this invention. The illustrated exemplary embodiment of the apparatus will be seen to comprise winding mandrels or arbors 4 defining winding drums. The printed products arriving in an imbricated product formation according to FIG. 1 are delivered in so-to-speak "underfeed" (as defined hereinafter) to one or more of the winding mandrels or arbors 4, respectively to the wound coil or product package forming thereupon, according to the initially mentioned German Patent Publication No. 3,123,888 and the cognate U.S. Pat. No. 4,438,618, to which reference may be had and the disclosure of which is incorporated herein by reference. In contrast thereto, however, the printed products overlap one another in the imbricated product formation only in their edge regions, as can be seen in FIG. 3. This imbricated product formation designated with the reference numeral 1 in FIG. 3 is delivered in "underfeed" to a related rotating driven winding mandrel or arbor 4, respectively to a wound coil or product package 5 forming thereupon, by the conveyor device formed by the endless circulating conveyor belts 2 and 3.

The term "underfeed" is not to be understood as necessarily a feed from beneath, but as a feed in which the printed products enter into contact with the outer layer of the wound coil or product package with the leading edges—usually the spine or bound edge—which overlap the preceding or precursive printed product on the side toward the center or axis of rotation of the coil or product package and arrive in the engaging or pinching gap 6 formed by the outer layer of the forming coil or package, on the one hand, and by the conveyor device 3, respectively the winding strap or band 7 on the other hand.

The component 3 of the conveyor device 2, 3 is constructed as a rocker or balance arm type conveyor belt pivotable about an axis or pivot shaft 8 and which can be pressed against the periphery of the wound coil or package 5 by means of a not particularly shown but conventional actuator. Although there is one circulating conveyor belt or more on the pivoting structure or component 3, such only serve to deliver the printed products to the coil or package 5 and not to drive it. This wound coil or product package 5 is driven exclusively by means of a not particularly shown drive motor which is operatively connected to the winding mandrel or arbor 4 by appropriate transmission means, for instance as disclosed in the aforementioned U.S. Pat. No. 4,438,618.

The end of the winding strap or band 7 is also connected to the winding mandrel or arbor 4. The winding strap 7 is withdrawn from a supply drum 9 during its winding up on the winding mandrel 4 and runs from this supply drum 9 to the wound coil or product package 5 while engaging the imbricated product formation stream 1 from beneath. The winding strap 7 is maintained under a prescribed tension by conventional means, e.g. by a braking device 100 acting on the supply drum 9, respectively on the core thereof.

The peripheral or circumferential speed of the wound product coil or package 5 and therewith also the speed of the winding strap or band 7 is regulated to correspond to the delivery speed or linear infeed velocity of the imbricated product formation 1. The winding mandrel or arbor 4 can be driven by a so-called winding transmission for this purpose.

The associated apparatus is described in the aforementioned German Patent Publication No. 3,123,888 and cognate U.S. Pat. No. 4,438,618, so that a detailed description is not necessary here. It need only be mentioned that the drive of the winding mandrel or arbor 4 on the one hand, and the subjection of the winding strap 7 to a prescribable tension force, on the other hand, lead to a compact coil or package in spite of the wide spacing of the imbricated products and the therefore correspondingly reduced compressibility of the imbricated product formation. Even when the products themselves are not very compressible, the weight of the printed products carried by the individual loops or coils can induce a compression of the wound coil or product package, respectively of the coil layers thereof, above the winding mandrel or arbor, so that the loops or coils with the printed products they carry deflect or sag and then roll on the driven winding mandrel or arbor. This rolling then leads to the initially described clock-spring wind-up effect, so that there is no shifting or smearing of the individual product copies or products. A comparison of the FIGS. 1 and 3 shows that the same number of printed products form a substantially longer imbricated product formation when they overlap only in their edge or marginal regions and that, in spite of reduced compressibility, the imbricated product formation does not reduce the number of secondary winding processes but increases it.

A transport device or apparatus, which is designated in its entirety with the reference numeral 14 in FIG. 2, is shown in FIG. 2 arranged downstream of the delivery belt 10 and comprising clamps or hooks or grippers, generally indicated with the reference numeral 11, and controllable in known manner for picking up the printed products 13 individually from the imbricated product formation 12 of FIG. 1. Three winding stations 15, 16 and 17 are each arranged or installed according to FIG. 3 in the motion or transport path of the clamps or grippers 11 of the transport device 14.

Similar components of each winding station 15, 16 and 17 are provided with corresponding reference numerals. In the region of the conveyor devices 2, 3 of the individual winding stations, there are provided the schematically shown release or control means 30, e.g. cam means, for the clamps or grippers 11 arranged such that the copies or products 13 are distributed to the winding stations and are deposited on the conveyor devices 2, 3 in an imbricated product formation in which the printed products only overlap at their edge regions, as shown in FIG. 3.

The construction and function of such a transport device 14 is, for example, known from the German Patent Publication No. 2,519,561. A more detailed description is therefore not necessary.

Concerning the overlapping of the printed products or the like at their edge regions, it is to be understood that not more than two product copies overlap one another at their edge regions. Furthermore, such overlapping of the printed products at the edge or marginal regions thereof is confined, as previously stated, to a fraction or minor portion of the length of the printed products between their leading and trailing edges. Specifically, this fraction or minor portion of the aforementioned length of the products amounts to less than 50%, preferably not more than 20%, and most preferably between 2% and 10% of such product length.

While there are shown and described present preferred embodiments of the invention, it is to be distinctly understood that the invention is not limited thereto, but may be otherwise variously embodied and practiced within the scope of the following claims.

Accordingly, what I claim is:

1. In an apparatus for the intermediate storage of printed products such as newspapers, magazines, or periodicals and the like in imbricated product formation, comprising:

a winding mandrel for winding up the imbricated product formation;

said winding mandrel being arranged to be rotatable and to be driveable at least during such winding up;

a conveyor divice for conveying the imbricated product formation to the winding mandrel;

at least one winding strap capable of being connected to the winding mandrel;

at least one tensioning apparatus for placing said at least one winding strap under a prescribable tension;

the at least one winding strap being wound between coil layers of the imbricated product formation during such winding up thereof;

the conveyor device supplying a flow of the imbricated product formation conjointly with the at least one winding strap to the winding mandrel in underfeed;

the flow of the imbricated product formation arriving at the winding mandrel with leading edges of the printed products in intimate contact with the previously wound coil thereof, the improvement which comprises:

a product deposition apparatus arranged upstream of the conveyor device for forming from the printed products an imbricated product formation in which said leading edge of each printed product overlaps a trailing edge of a preceding one of the printed products in the imbricated product formation exclusively at an edge region of the preceding printed product such that at most two printed products mutually overlap at each edge region;

a delivery belt upon which arrive the printed products in imbricated product formation;

a transport device having controllable grippers and provided with said product deposition apparatus and being arranged subsequent to the delivery belt;

at least two said conveyor devices being arranged in the transport path of said controllable grippers of said transport device;

said at least two conveyor devices each leading to a respective winding mandrel;

said transport device being provided with said controllable grippers for individually gripping the printed products; and said product deposition apparatus including control means for releasing predetermined ones of the grippers provided at the region of said at least two conveyor devices such that the printed products are deposited upon the individual conveyor divices in imbricated product formation with said leading edges overlapping said trailing edges by at most a minor portion of the length between the leading edge and the trailing edge of each printed product.

2. The apparatus as defined in claim 1, wherein:

said product deposition apparatus forms from the printed products an imbricated product formation having said overlapping edge regions wherein the extent of such overlap amounts to less than 50% of the length between a leading edge and trailing edge of each printed product.

3. The apparatus as defined in claim 2, wherein:

said overlap amounts to less than 20% of said length.

4. The apparatus as defined in claim 3, wherein:

said overlap amounts to between 2% and 10% of said length.

* * * * *